US005107671A

United States Patent [19]

Morihashi et al.

[11] Patent Number: 5,107,671

[45] Date of Patent: Apr. 28, 1992

[54] MULTI-PLY SPUN YARN AND METHOD FOR PRODUCING THE SAME

[75] Inventors: Toshifumi Morihashi; Teruo Nakayama, both of Ohtsu; Koshi Noda, Joyo; Susumu Banba, Kyoto, all of Japan

[73] Assignee: Murata Kikai Kabushiki Kaisha, Kyoto, Japan

[21] Appl. No.: 620,381

[22] Filed: Nov. 30, 1990

Related U.S. Application Data

[63] Continuation of Ser. No. 427,034, Oct. 25, 1989, abandoned.

[30] Foreign Application Priority Data

Oct. 26, 1988 [JP] Japan ..... 63-270381
Oct. 27, 1988 [JP] Japan ..... 63-271621
Mar. 10, 1989 [JP] Japan ..... 1-59076

[51] Int. Cl.[5] ..... D01H 1/115
[52] U.S. Cl. ..... 57/328
[58] Field of Search ..... 57/328, 22, 261, 289, 57/309, 331, 352, 204, 315, 293, 204

[56] References Cited

U.S. PATENT DOCUMENTS 3,175,351 3/1965 Bloch ..... 57/309
4,055,039 10/1977 Movshovich et al. ..... 57/293
4,068,459 1/1978 Movshovich et al. ..... 57/293
4,084,400 4/1978 Movshovich et al. ..... 57/293
4,142,354 3/1979 Nakahara ..... 57/328
4,206,589 6/1980 Markey et al. ..... 57/293
4,351,146 9/1982 Faure et al. ..... 57/328 X
4,484,436 11/1984 Nakayama et al. ..... 57/328
4,535,944 8/1985 Nakahara et al. ..... 57/328 X
4,565,063 1/1986 Stalder et al. ..... 57/328
4,711,080 12/1987 Shibazaki et al. ..... 57/328 X
4,790,130 12/1988 Stahlecker et al. ..... 57/328 X
4,819,422 4/1989 Stahlecker et al. ..... 57/328

FOREIGN PATENT DOCUMENTS 75124 4/1988 Japan .

*Primary Examiner*—Joseph J. Hail, III
*Attorney, Agent, or Firm*—Spensley, Horn, Jubas & Lubitz

[57] ABSTRACT

A multi-ply spun yarn having a self-converging property and a method for producing it. In the method wherein fiber is drafted first and introduced into an air jetting twisting device, and then yarns spun out by the twisting device are joined together by a guide member and taken up onto a take-up device, the twisted yarns are joined together after separated by a separating guide.

8 Claims, 7 Drawing Sheets

FIG. 1
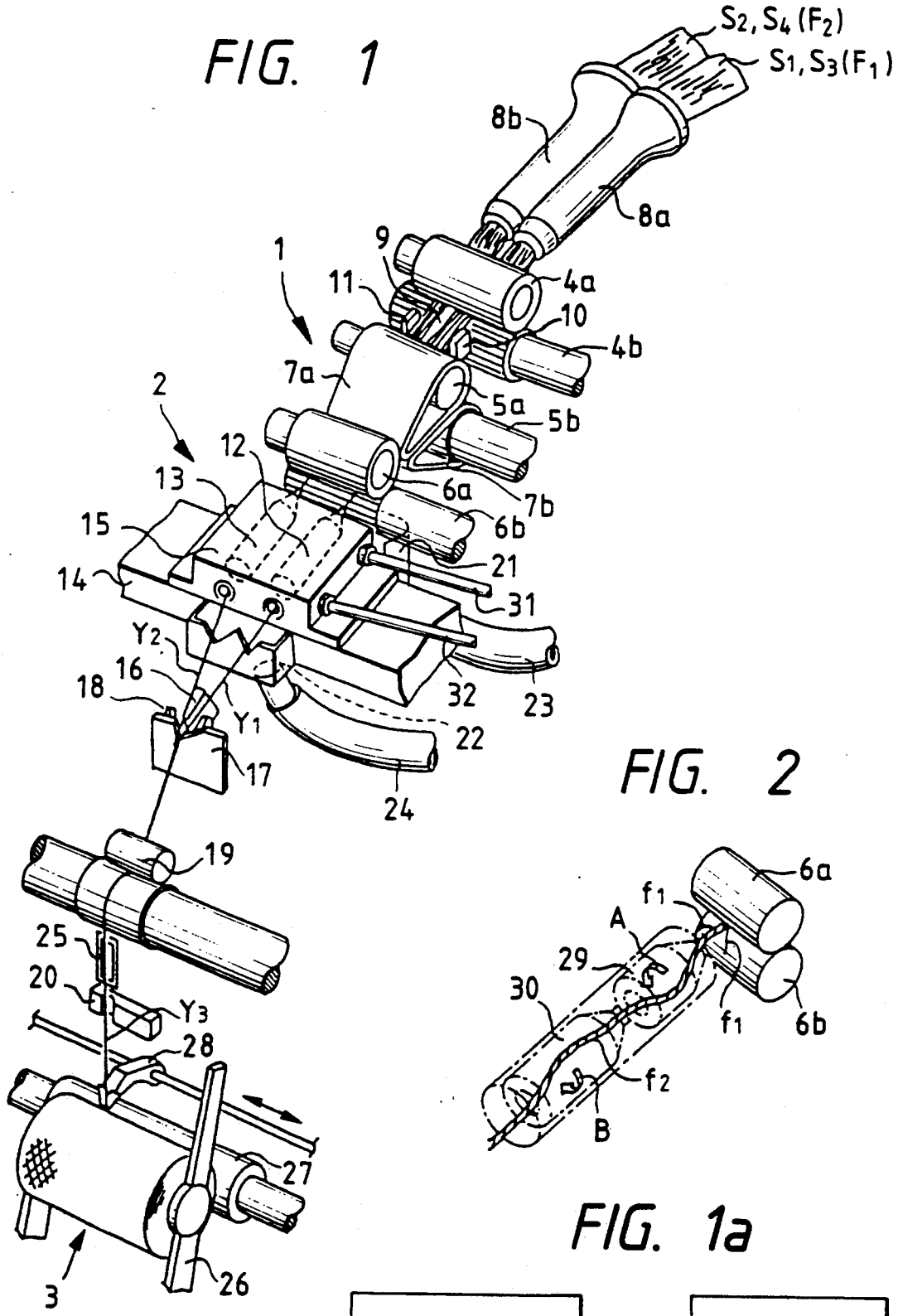
FIG. 2
FIG. 1a
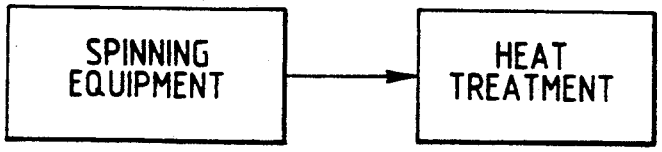

MULTI-PLY SPUN YARN AND METHOD FOR PRODUCING THE SAME

This is a continuation of application Ser. No. 07/427,034 filed on Oct. 25, 1989, now abandoned.

FIELD OF THE INVENTION

This invention relates to a multi-ply spun yarn having a self-converging property and an apparatus for producing the multi-ply spun yarn.

RELATED ART STATEMENT

A conventional doubling and twisting step proceeds such that packages of yarns spun out by a ring spinning machine and wound by an automatic winder are placed on a doubling machine and a two ply yarn doubled on the doubling machine is further twisted by a double twister. Since a two ply yarn obtained in this manner on a doubling machine is formed by merely putting yarns produced by ring spinning in order to make a two ply yarn, it comes short of entwining of single yarns with each other. Accordingly, such a problem is recognized that such two ply yarn is readily separated at a yarn twisting step by a double twister or the like.

It has been proposed that a ply yarn is obtained by twining a plurality of bundled spun yarns produced by drafting slivers by means of a draft device and twisting the slivers by means of an air jetting twisting device.

OBJECT AND SUMMARY OF THE INVENTION

It is an object of the present invention to provide a two ply yarn having a structure which does not allow the yarn to be separated readily at a yarn twisting step.

It is another object of the present invention to produce a bulky ply yarns.

It is still another object of the present invention to provide a spinning equipment wherein the doubling point of twisted spun yarns is fixed to obtain a spun yarn of a stabilized quality.

According to an embodiment of the present invention, a multi-ply spun yarn having a self-converging property is constituted such that it is formed by joining together a plurality of bundled spun yarns obtained by drafting slivers by means of a draft device and twisting the slivers by means of an air jetting twisting device and fibers wrapped around outer peripheries thereof are entwined with the outer peripheral faces of the other spun yarns.

The multi-ply spun yarn of embodiment of the present invention will not be separated readily into individual single yarns even during transportation to a yarn twisting step nor in the yarn twisting step.

In the multi-ply spun yarn mentioned above, the slivers of high shrinkage fiber and slivers of low shrinkage fiber are spun out into a yarn, and then the spun yarn taken up is treated by heating to cause thermal shrinkage and to produce a bulky spun yarn.

According to an embodiment of the present invention a two ply spinning equipment wherein a pair of sets of air nozzles are disposed in parallel to each other with respect to a draft device which is constituted from back rollers, aprons, front rollers and so forth and a yarn doubling guide for doubling two twisted yarns is disposed on the downstream of the air nozzles, is constituted such that a separating member for the twisted yarns is provided forwardly of the yarn doubling guide.

The separating member is provided forwardly of the yarn doubling guide and acts to prevent propagation of the doubling point of two twisted yarns to the upstream so as to keep the doubling point forwardly of the yarn doubling guide.

BRIEF DESCRIPTION OF THE DRAWINGS

FIG. 1 and FIG. 1*a* are a perspective views showing spinning equipment for obtaining a spun yarn, according to a first embodiment of the present invention;

FIG. 2 is a perspective view showing a part of an air jetting nozzle of a yarn twisting device used in an embodiment of the present invention;

DETAILED DESCRIPTION OF PREFERRED EMBODIMENTS

Figure 3:
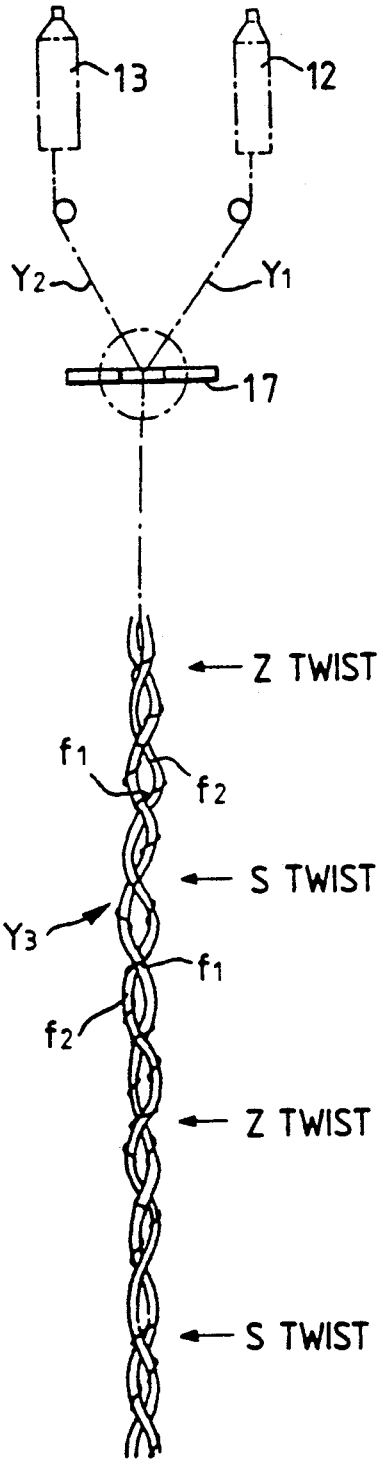
FIG. 3 is an explanatory view schematically showing a spun yarn of an embodiment of the present invention.

In the following, an embodiment of the present invention will be described with reference to the drawing.

FIG. 1 is a perspective view showing an outline of an equipment for carrying out the process of an embodiment of the present invention, and the equipment shown is constituted from a draft device 1 for drafting slivers $S_1$ and $S_2$ supplied from a plurality of sliver cans not shown, an air jetting twisting device 2 for twisting the slivers $S_1$ and $S_2$ drafted by the draft device 1 into spun yarns $Y_1$ and $Y_2$, respectively, and a take-up device 3 for joining the thus spun out yarns $Y_1$ and $Y_2$ together and taking up them as a bundled spun yarn $Y_3$.

The draft device 1 is composed of a pair of back rollers 4*a* and 4*b*, a pair of middle rollers 5*a* and 5*b* and a pair of front rollers 6*a* and 6*b* wherein the circumferential speed is set to increase in this order, and the middle rollers 5*a* and 5*b* in pair have apron belts 7*a* and 7*b* mounted thereon. Reference characters 8*a* and 8*b* denote sliver guides placed in a juxtaposed relationship to each other for feeding slivers $S_1$ and $S_2$ supplied from the sliver cans into the back rollers 4*a* and 4*b*. Meanwhile, reference numeral 9 denotes a sliver separating guide provided between the back rollers 4*a* and 4*b* in pair and the middle rollers 5*a* and 5*b* in pair, and the sliver separating guide 9 separates the slivers $S_1$ and $S_2$ inserted in a parallel condition into the back rollers 4*a* and 4*b* in pair. Then, a pair of guide blocks 10 and 11 are provided on the left and right of the separating guide 9, respectively, and restrict leftward and rightward expansion of the two rows of slivers $S_1$ and $S_2$ separated by the separating guide 9.

Accordingly, the two rows of slivers $S_1$ and $S_2$ separated at the position of the separating guide 9 are drafted while maintaining the two parallel row condition also at the following position of the middle rollers 5a and 5b in pair and at the position of the front rollers 5a and 5b in pair, whereafter they are introduced into the air jetting nozzles 12 and 13 of the twisting device 2. The twisting device 2 includes the air jetting nozzles 12 and 13 provided in a juxtaposed relationship in a housing 15 secured to a frame 14 The individual air jetting nozzles 12 and 13 have a function to twist the slivers $S_1$ and $S_2$ supplied thereto independently of each other into spun yarns $Y_1$ and $Y_2$.

Thus, the spun yarns $Y_1$ and $Y_2$ obtained by the twisting step 2 described above are subsequently joined together by a guide member 17 to double them.

Reference numeral 16 denotes a separating guide for preventing the joined point of the spun yarns $Y_1$ and $Y_2$ by the guide member 17 from floating to the upstream or the downstream along a yarn path, and the separating guide 16 prevents unevenness of wrapping amounts of the spun yarns $Y_1$ and $Y_2$ which may be caused when the joined point floats to the upstream side.

Reference numeral 18 denotes a cutter provided at the position of the guide member 16, and the cutter 18 is rendered operative in response to a yarn defect detection signal from a slub catcher 20 which is provided intermediately of a downward yarn path from a delivery roller 19 to the take-up device 3 for detecting a defect portion of a yarn.

Reference numerals 21 and 22 denote each a dust sucking port for waste yarns, fly waste and so forth, and 23 and 24 denote each a suction pipe for air.

Reference numeral 25 denotes a slack tube for sucking the yarns $Y_1$ and $Y_2$ out from the air jetting nozzles 12 and 13 to prevent slacking of the yarns upon starting of spinning or upon yarn splicing.

The take-up device 3 is constituted from a bobbin supported on a known cradle arm 26, a friction roller 27 held in rolling contact with the bobbin (or a package) for driving the bobbin (or the package) to rotate, and a traverse guide 28.

Then, as shown in FIG. 2, the twisting device 2 which is used in an embodiment of the present invention includes the air jetting nozzles 12 and 13 disposed in a juxtaposed relationship in two rows in the housing 15 secured to the frame 14 and each including a pair of air nozzles 29 and 30 provided in series to each other (the upstream side one of the air nozzles will be hereinafter referred to as first nozzle 29 while the downstream side one as second nozzle 30), and the individual air jetting nozzles 12 and 13 have a function to twist the slivers $S_1$ and $S_2$ supplied thereto independently of each other into spun yarns $Y_1$ and $Y_2$.

Since the air jetting nozzles 12 and 13 have the same mechanism, description will be hereinafter given only of one of them In particular, as shown in FIG. 2, the air jetting nozzles 12 and 13 have a plurality of air jetting fine holes (not shown) provided therein for jetting air in tangential directions into passages for slivers which are formed through the center axes of the air jetting nozzles 12 and 13 so that air flows which whirl in the opposite directions as indicated by arrow marks A and B may be formed in the passages by the air jetting small holes Reference numerals 31 and 32 denote supply pipes of compressed air to the first nozzle 29 and the second nozzle 30, respectively.

Thus, a multi-ply spun yarn having a self-converging property of the present invention is formed in the following manner by the spinning equipment having such a construction as described above. In particular, temporary twists in the same direction as the directions of whirling airs flow B of the second nozzles 30 are applied by the whirling air flows B to slivers introduced into the air jetting nozzles 12 and 13 of the twisting device, and the temporary twists propagate to a position near nip points provided by the front rollers 61 and 6b.

The slivers S coming out of the front rollers 6a and 6b are converged by the temporary twists provided by the second nozzles 30, but between the front rollers 6a and 6b and the first nozzles 29, the slivers S are ballooned in the opposite directions to the temporary twists by the first nozzles 29. By the balloons, fibers (open end fibers) $f_1$ are produced whose trailing ends are still held grasped between the front rollers 6a and 6b and hence remain in fibers constituting the slivers while leading ends are already free. The fibers $f_1$ are wrapped, by the balloons in the opposite direction to the temporary twists between the front rollers 6a and 6b and the first nozzles 29 and also by air flows A of the first nozzles 29, around core fiber bundles $f_2$ in the opposite directions to the temporary twists provided by the second nozzles 30. Then, the fibers $f_1$ are wrapped further strongly around the core fibers $f_2$ with sufficient wrapping turns in the opposite directions to the inserted temporary twists at a step at which the temporary twists are untwisted after the fibers $f_1$ have passed the second nozzles 30. Consequently, so-called bundled spun yarns $Y_1$ and $Y_2$ are formed.

The two spun yarns $Y_1$ and $Y_2$ still have twisting torques therein until they pass the delivery roller 19 and thus remain, as it were, at a yarn forming process, and while the twisting torques remain, the two spun yarns $Y_1$ and $Y_2$ are put in order and joined together by the guide member 17. Accordingly, the yarns are entwined with each other at the joining point.

In particular, since the open end fibers $f_1$ wrapped around the core fibers $f_2$ are initially such fibers that they are free at one ends thereof as described hereinabove, even after they come out of the air jetting nozzles 12 and 13, some of them still remain projected at one ends thereof like fluff, and such fibers $f_1$ do not contribute to formation of yarns. Thus, at a twisting torque loosing process of the core fiber bundles $f_2$, the fibers $f_1$ advances to the downstream of the yarn paths while whirling around the yarns as the core fiber bundles $f_2$ are twisted back, and at the joining point provided by the guide member 17, the fibers $f_1$ are entwined with the other spun yarns $Y_1$ and $Y_2$ to each other as shown in FIGS. 3 and 4.

Figure 4:
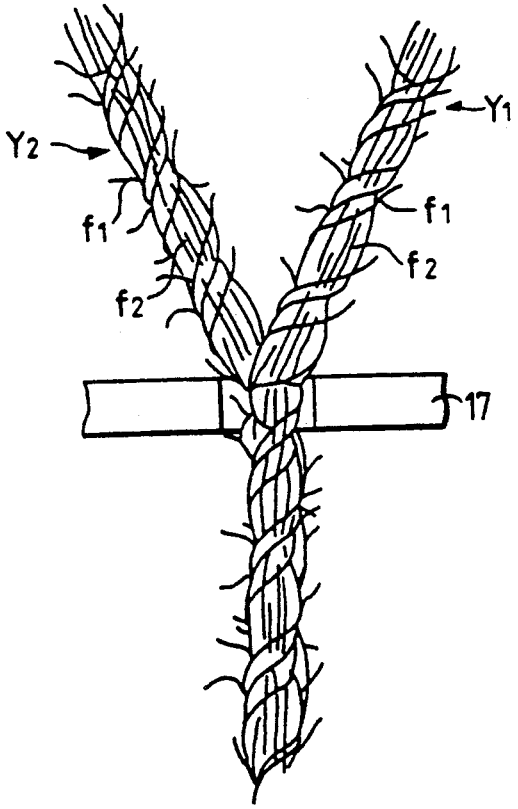
FIG. 4 is an enlarged schematic view of a portion in a circle of an alternate long and short dash line in FIG. 3.

Then, release of the twisting torques remaining in the core fibers $f_2$ is promoted by such entwining of the open end fibers $f_1$, and the twisting torques released here cause the spun yarns $Y_1$ and $Y_2$ to be further entwined with each other either in the S twist direction or in the Z twist direction as shown in FIG. 3. Since the entwining of the spun yarns $Y_1$ and $Y_2$ is originally caused only by a twisting back force provided by the remaining torques, the number of twists is small (50 to 100 turns or so for a yarn length of 1 cm), and if an S twist portion continues, then a Z twist portion is produced by a torque accumulated by such S twist.

It is to be noted that, while the individual spun yarns $Y_1$ and $Y_2$ themselves of the two ply yarn of FIG. 3 both have the Z twist, the two ply yarn configuration may have the S twist or the Z twist as described above, or one of the spun yarns $Y_1$ and $Y_2$ may have the S twist while the other has the Z twist.

Figure 5:
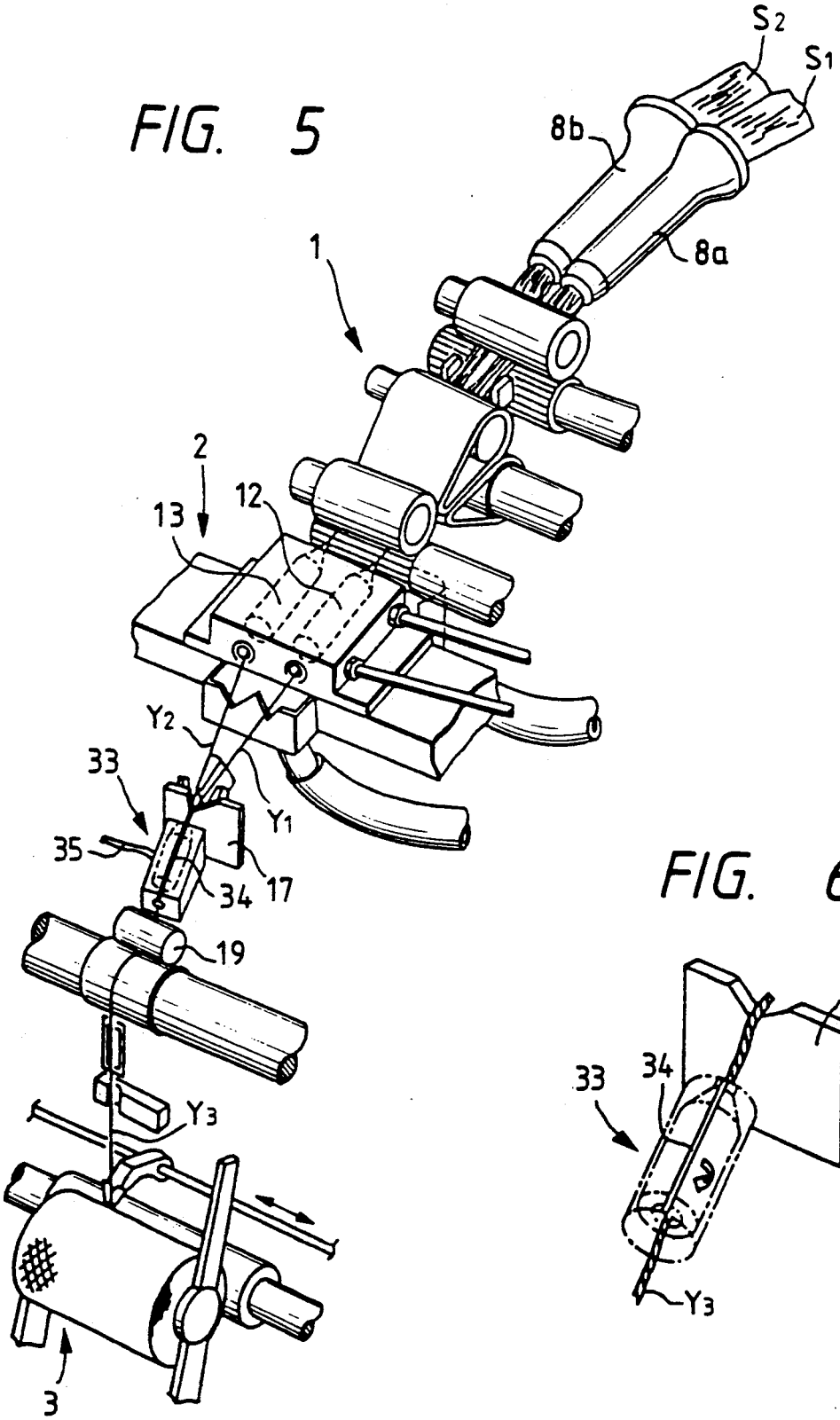
FIG. 5 is a perspective view showing spinning equipment for obtaining a spun yarn, according to a second embodiment of the present invention.

Subsequently, a device shown in FIG. 5 as a second embodiment of the present invention for obtaining a spun yarn has no different construction from the first embodiment described hereinabove except that a temporary twisting device 33 of the air jet type is interposed between the delivery roller 19 and the guide member 17 by which spun yarns $Y_1$ and $Y_2$ obtained by the twisting step 2 are joined together in the first embodiment described hereinabove. Accordingly, like parts are denoted by like reference characters.

Figure 6:
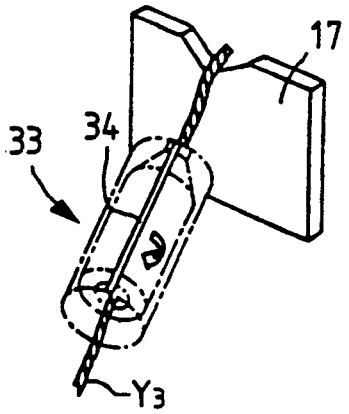
FIG. 6 is a perspective view showing a part of a temporary twisting nozzle of the air jet type used in the second embodiment.

Then, the air jet type temporary twisting nozzle 33 has, as shown in FIG. 6, a similar structure to the second nozzle of the twisting device 2 described hereinabove, and a whirling air flow formed toward the path has the same direction as the whirling direction B of air by the second nozzles 30 of the twisting device 2 described hereinabove, that is, the same direction as the wrapping direction of outer peripheral fibers. Thus, where the whirling directions of air in the second nozzles 30 of the air jetting nozzles 12 and 13 of the twisting device 2 are different from each other, the whirling air flows formed toward the paths are made coincide with the whirling direction of either one of the second nozzles.

Reference numeral 34 denotes a slit provided in a direction parallel to the path of the air jet type temporary twisting device 30, and the slit 34 facilitates insertion of yarns $Y_1$ and $Y_2$ joined together in the path. Reference numeral 35 denotes a feeding pipe of compressed air into the jet type temporary twisting device 31.

Thus, the spun yarns $Y_1$ and $Y_2$ put in order and joined together by the guide member 17 and entwined with each other are introduced into the air jet type temporary twisting device 33 so that further temporary twists are applied to them, and in a process in which the temporary twists are untwisted after the spun yarns $Y_1$ and $Y_2$ have passed the air jet type temporary twisting device 33, the fibers $f_1$ on the spun yarns $Y_1$ and $Y_2$ are wrapped further strongly with sufficient wrapping turns in the opposite directions to the inserted temporary twists. Consequently, a multi-ply spun yarn $Y_3$ can be obtained which has such a self-converging property that it is more difficult to separate than a yarn obtained by the first embodiment.

Accordingly, a spun yarn having a self-converging property according to an embodiment of the present invention is produced such that slivers $S_1$ and $S_2$ supplied from the sliver cans pass between the back rollers 4*a* and 4*b* in pair, middle rollers 5*a* and 5*b* in pair and front rollers 6*a* and 6*b* in pair of the draft device 1 while being kept in a separated condition, and the two rows of slivers $S_1$ and $S_2$ coming out of the front rollers 6*a* and 6*b* in pair are individually drafted to desired degrees and introduced into the air jetting nozzles 12 and 13 from which they are spun out as two spun yarns $Y_1$ and $Y_2$, whereafter they are put in order and joined together by the guide member 17 and then taken up as a spun yarn $Y_3$ onto the bobbin of the take-up device 3 to form a package P after passing the delivery roller 19. The spun yarn thus produced is then transferred to a next yarn twisting step. However, even during such transfer or at the yarn twisting step, the spun yarn in such an entwined condition as described hereinabove will not be separated readily, and accordingly, the spun yarn is easy to undergo such after processing and easy to handle.

It is to be noted that, while it has been described that, in the embodiments described above, two rows of slivers are supplied in a juxtaposed relationship into a spinning equipment of a spindle, there is no trouble even if a row of slivers is supplied into each of spindles and yarns spun out from twisting devices are joined together by means of a guide member. Further, naturally the number of yarns to be joined may be a plural number greater than 2.

Further, the guide member is not limited to such a plate-like member as shown in the drawings, and a guide member of an arbitrary configuration such as a configuration wherein yarns pass between and are jointed together by a pair of pins can be employed as the guide member.

As described in detail so far, according to an embodiment of the present invention, a multi-ply spun yarn having a self-converging property is a yarn which is formed by joining together a plurality of bundled spun yarns obtained by drafting slivers by means of a draft device and twisting the slivers by means of an air jetting twisting device and wherein fibers wrapped around outer peripheries thereof are entwined with the outer peripheral faces of the other spun yarns. Accordingly, distinct from a two ply yarn obtained by merely putting ring spun yarn in order and joining them together, the yarn of the present invention has a self-converging property which does not allow the yarn to be separated readily, and even during transfer to a next yarn twisting step or at the yarn twisting step, the yarns will not be separated from each other or broken. Consequently, occurrence of such problems can be prevented perfectly, and the commodity value of the yarn as a bundled spun yarn can be increased to a great extent.

According to an embodiment of the present invention in which doubling process is included in the pneumatic spinning process, a plurality of twisted yarns spun out from each jetting nozzle have substantially same or similar tension.

So, the multi-ply spun yarn of an embodiment of the present invention has not such inconvenience that the yarn having small tension wraps around the yarn having large tension in the subsequent step in a two-for-one twister. If yarns taken up on packages are doubled by the known doubling method, it is impossible to adjust tension of the yarns to be doubled at same degree so that a yarn having smaller tension twins around another yarn.

Furthermore, a single yarn which is obtained by the pneumatic spinning method and has less winding fibers therearound has extremely low yarn strength, and is impossible to be processed to a subsequent step. However, the yarn strength can be increased by doubling soft and weak yarns having such low yarn strength and the doubled yarn may be processed to &he subsequent steps.

As the method for producing a multi-ply spun yarn consisting of two or more kinds of fibers, it is known that two kinds of slivers are arranged together and introduced into one air jetting nozzle is disclosed in Japanese Patent Laid-open No. 63-75124. According to the present invention, a composite spun yarn having an excellent quality can be obtained.

Subsequently, the process of the third embodiment of the present invention of producing a bulky spun yarn which is superior in bulkiness using the spinning equipment shown in FIG. 1 and feeding slivers of high shrinkage fiber and slivers of low shrinkage fiber will be described.

In carrying out the process of the embodiment, at first slivers $S_3$ of low shrinkage fiber $F_1$ from which a yarn of a preset low count of yarn can be obtained and slivers $S_4$ of high shrinkage fiber $F_2$ from which a yarn of a preset high count of yarn can be obtained are prepared. As for the kind of fiber, any fiber can be used only if it has either a high degree of shrinkage or a low degree of shrinkage, but most preferably, low shrinkage acrylic resin fiber and high shrinkage acrylic resin fiber are used.

Then, such slivers $S_3$ and $S_4$ are supplied into the sliver, guides 8*a* and 9*b* shown in FIG. 1, respectively, and then pass between the back rollers 4*a* and 4*b* in pair, middle rollers 5*a* and 5*b* in pair and front rollers 6*a* and 6*b* in pair of the draft device 1 while being kept in a separated condition from each other. The two rows of slivers $S_3$ and $S_4$ coming out of the front rollers 6*a* and 6*b* thus have desired drafts applied thereto and are then introduced into the air jetting nozzles 12 and 13 so that they are spun out into a spun yarn $Y_1$ of a low count of yarn composed or the high shrinkage fiber and another spun yarn $Y_2$ of a high count of yarn composed of the high shrinkage fiber. The spun yarns $Y_1$ and $Y_2$ are then put in order and joined together by the guide member 17 and then pass the delivery roller 19 whereafter they are taken up as a bundled spun yarn $Y_3$ on the bobbin of the take-up device 3 to form a package.

The bundled spun yarn $Y_3$ obtained in this manner is then transferred to a heat treatment step at which it is heat treated. The high shrinkage fiber $F_2$ of a high count of yarn in the spun yarn $Y_3$ is thus shrunk at a high degree of shrinkage, and by the shrinking force, the low shrinkage fiber $F_1$ of a low count of yarn are wrapped uniformly around a surface of the high shrinkage fiber $F_2$ to prevent mutual slipping between the fibers. Consequently, a flexible, bulky yarn can be obtained wherein the center of the yarn $Y_3$ is composed of the high shrinkage fiber $F_2$ and the surface is composed of the low shrinkage fiber $F_1$.

It is to be noted that, while it has been described that, in the embodiment described above, two rows of slivers are supplied in a juxtaposed relationship into a spinning equipment of a spindle, there is no problem even if a row of slivers is supplied into each of spindles and yarns spun out from twisting devices are joined together by means of a guide member.

Further, the guide member is not limited to such a plate-like member as shown in the drawing, and a guide member of an arbitrary configuration such as a configuration wherein yarns pass between and are jointed together by a pair of pins can be employed as the guide member.

As described in detail so far, according to an embodiment of the present invention, a process of producing a bulky spun yarn wherein fiber is drafted first and then introduced into an air jetting twisting device, and then yarns spun out by the twisting device are joined together and taken up onto a take-up device whereafter the yarns are treated by heating, is constituted such that slivers of high shrinkage fiber are spun out into a yarn of a high count of yarn while slivers of low shrinkage fiber are spun out into a yarn of a low count of yarn, and then the two yarns are joined together, whereafter the spun yarn taken up is treated by heating to cause thermal shrinkage of the high shrinkage fiber. Accordingly, the high shrinkage fiber of a high count of yarn positioned at the center of the spun yarn is shrunk to a great degree by the heat treatment while the low shrinkage fiber of a low count of yarn surrounding the periphery of the high shrinkage fiber is wrapped further strongly and uniformly around the high shrinkage fiber so that the entire fibers make a very bulky spun yarn. As a result, it becomes possible to produce, by means of a spinning equipment which conventionally is not suitable for production of a bulky spun yarn, that is, a spinning equipment wherein fiber drafted by a draft device is introduced into a twisting device including an air jetting nozzle to apply twists to the fiber to produce a spun yarn, a very soft and bulky spun yarn from which woven cloth having a soft touch can be obtained.

Next, another embodiment of the spinning equipment which may be applied to the present invention will be described hereinafter referring to FIGS. 7 to 11.

Figure 11:
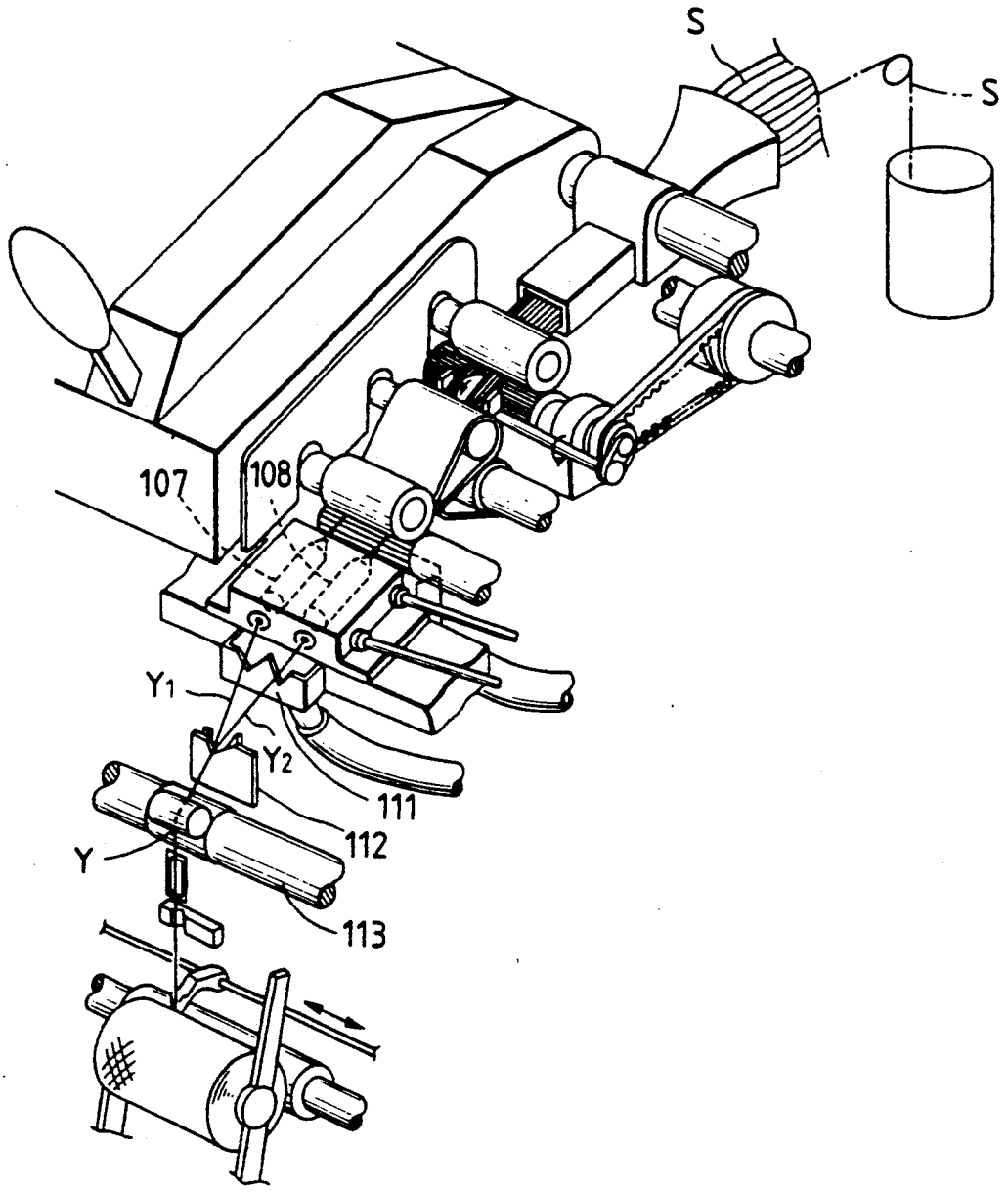
FIG. 11 is a perspective view showing a part of a spinning equipment.

In the two ply spinning equipment described above, the yarn doubling guide 17 for doubling two twisted yarns $Y_1$ and $Y_2$ plays an important role. However, the two twisted yarns $Y_1$ and $Y_2$ are not always doubled at the V-shaped joining point of the yarn doubling guide 112 as shown in FIG. 11. Particularly where the two twisted yarns $Y_1$ and $Y_2$ have the same directions of twists such as the S twist - S twist or the Z twist - Z twist, the doubling point of them propagates to the upstream. Accordingly, actually the doubling point of the two twisted yarns $Y_1$ and $Y_2$ stays between the yarn doubling guide 112 and the yarn guide 111, and besides position thereof is not fixed but is normally pulsating. It has become apparent that there is a problem that such pulsation of the doubling point provides a random variation to twists of the yarn $Y_1$ by the whirling flows A and B shown in FIG. 2 so that it makes a cause of a defect in quality of the spun yarn Y.

This embodiment of the present invention has been made in view of such a problem the two ply spinning equipment has as described above, and it is an object of the embodiment to provide a spinning equipment wherein the doubling point of twisted yarns $Y_1$ and $Y_2$ is fixed to obtain a spun yarn Y of a stabilized quality.

In order to attain the object, according to the embodiment a two ply spinning equipment wherein a pair of sets of air nozzles are disposed in parallel to each other with respect to a draft device which is constituted from back rollers, aprons, front rollers and so forth and a yarn doubling guide for doubling two twisted yarns is disposed on the downstream of the air nozzles, is constituted such that a separating member for the twisted yarns is provided forwardly of the yarn doubling guide.

Then, preferably a yarn guide for guiding the two twisted yarns in a separated relationship is provided between the air nozzles and the separating member, and the yarn guide has a projected portion extending upwardly between guide spacings for the two twisted yarns and having a narrow upper end and a lower portion which is greater in width than the separating member.

The separating member is provided forwardly of the yarn doubling guide and acts to prevent propagation of the doubling point of two twisted yarns $Y_1$ and $Y_2$ to the upstream so as to keep the doubling point forwardly of the yarn doubling guide.

Then, the projected portion of the yarn guide acts to expand, when two twisted yarns $Y_1$ and $Y_2$ are to be introduced, upon yarn break, to a knotter (yarn splicing device) by a suction pipe, the two twisted yarns $Y_1$ and $Y_2$ to maintain the distance between them so that the twisted yarns may be positioned with cetainty on the opposite sides of the separating member forwardly of the yarn doubling guide.

Figure 7:
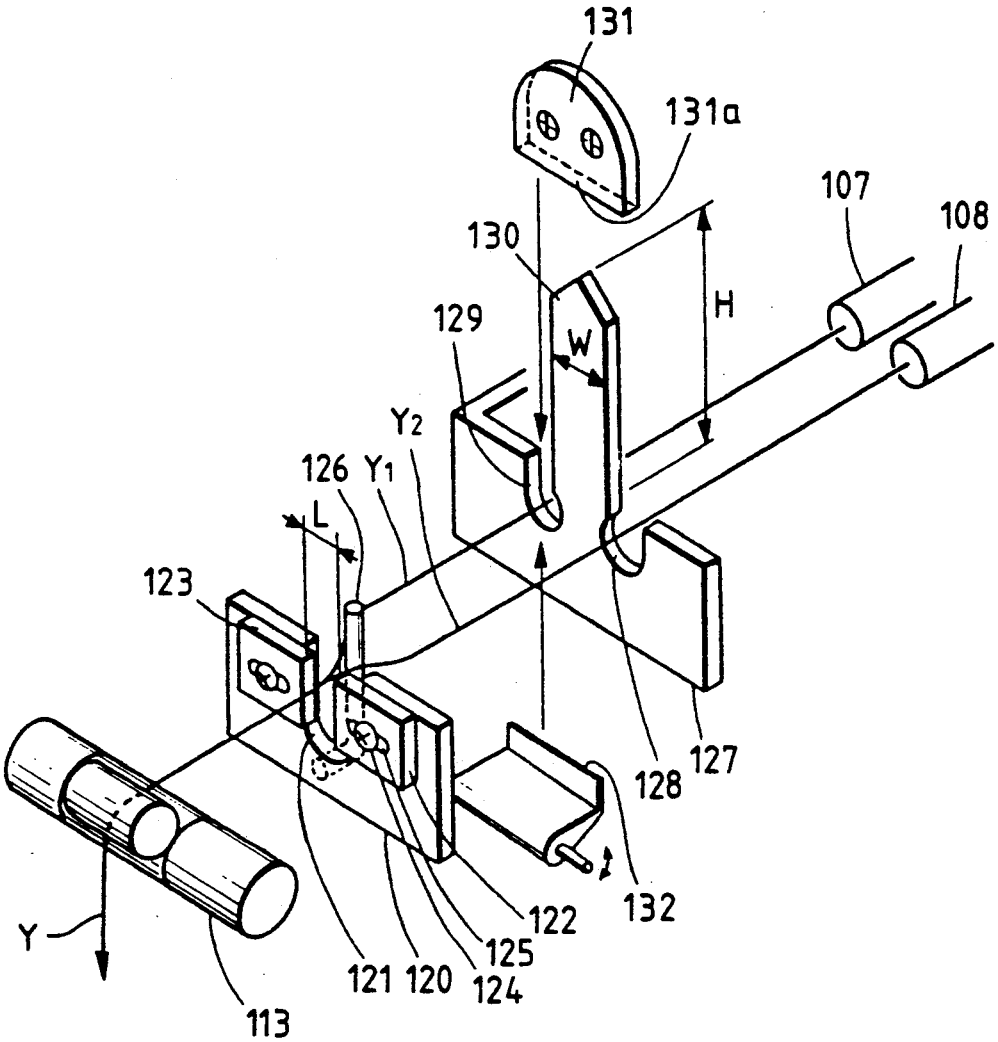
FIG. 7 is a perspective view showing details of a yarn doubling guide and a yarn guide.

FIG. 7 is a perspective view showing details of a yarn doubling guide and a yarn guide.

Referring to FIG. 7, a yarn doubling guide 120 has a U-shaped recess 121 at the center thereof and has a pair of width defining plates 122 and 123 secured thereto on the opposite sides of the U-shaped recess 121 by means of bolts 124. The width defining plates 122 and 123 are movable in horizontal directions by loosening the bolts 124 and adjusting the positions of elongated holes 125. Accordingly, the width of a joining point of twisted yarns $Y_1$ and $Y_2$ can be adjusted to an optimum width "L" in accordance with the thicknesses of the twisted yarns $Y_1$ and $Y_2$.

Figure 8:
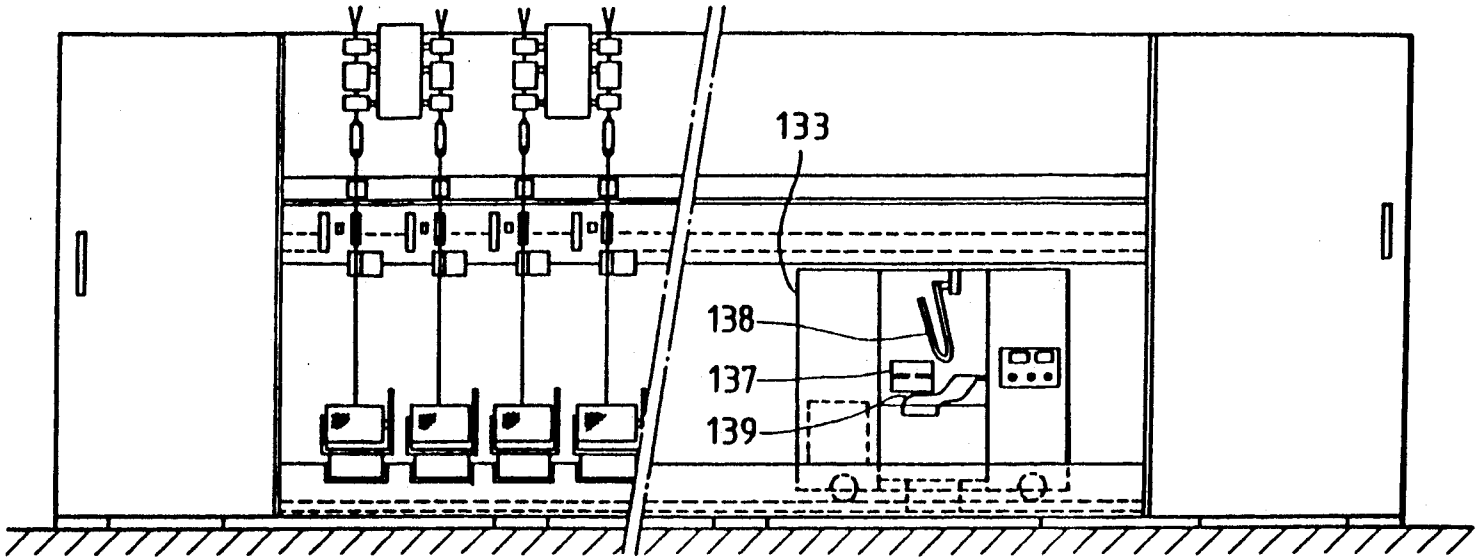
FIG. 8 is a front elevational view of an entire spinning equipment.

A separating bar 126 serving as a separating member is bent substantially in an L-shape and securely mounted on the yarn doubling guide 120 below the recess 21. And, the separating bar 126 is constructed to be positioned at the center of the U-shaped recess 121, and the separating bar 126 is adjusted also by adjustment of the positions of the width defining plates 122 and 123 so that it may be positioned at the center of the width "L". It is to be noted that the separating member is not limited to a bar-like member but may be in the form of a plate having a triangular cross section. Further, the separating member need not be securely mounted on the yarn doubling guide 120 but may be securely mounted on either one of the width defining plates 122 and 123. The recess 121 of the yarn doubling guide 120 is not limited to a U-shaped one but may have such a V-shape as shown in FIG. 8 with width defining plates positioned on the opposite sides thereof. However, the separating member preferably has a structure wherein it can be positioned at the center of the recess 121 of the yarn guide 120.

A yarn guide 127 has a pair of recess 128 and 129 of an eyeglasses-shaped configuration on yarn paths of the twisted yarns $Y_1$ and $Y_2$ and is adapted to guide the twisted yarns $Y_1$ and $Y_2$ from the air nozzles 107 and 108. A projected side 130 having a width "W" and a height "H" is provided in an integral relationship between the recesses 128 and 129. The end of the projected piece 130 is pointed so that the twisted yarns $Y_1$ and $Y_2$ may be separated to the left and right from each other. It is to be noted that a separating guide 131 having a semicircular upper portion can be mounted on a side face of the yarn guide 127 above the recesses 128 and 129, and a bottom edge 131*a* of the separating guide 131 can serve also as a contacting face of a yarn cutter 132 of the rocking type.

Figure 9:
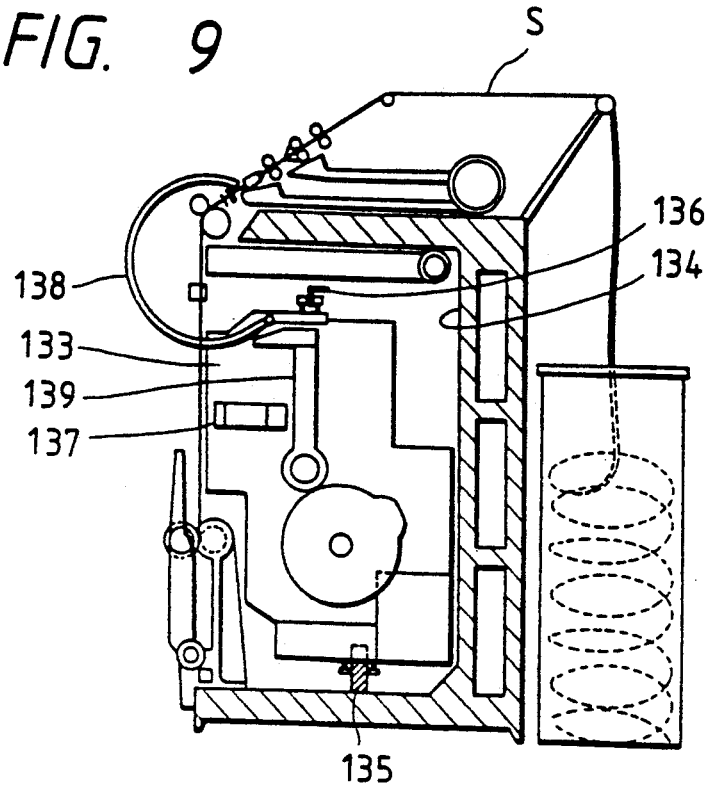
FIG. 9 is a sectional view of spinning equipment.
Figure 10:
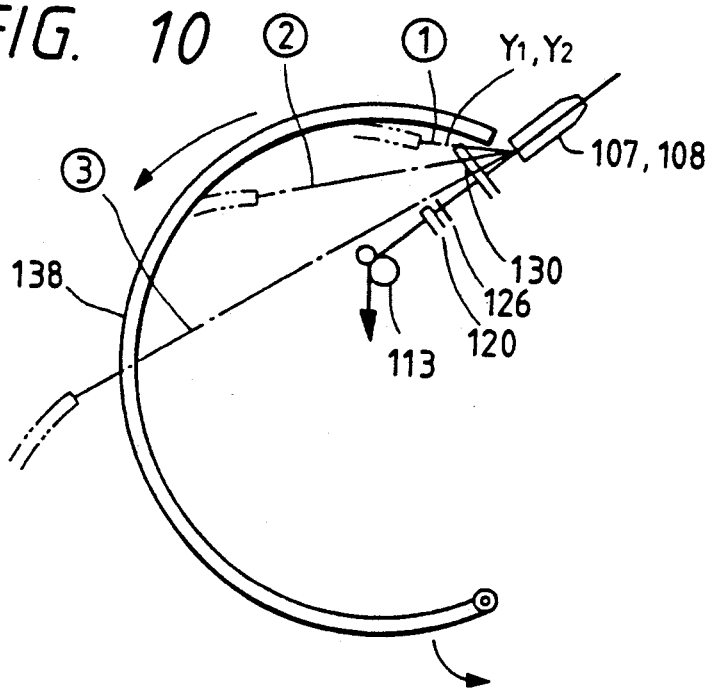
FIG. 10 is a view illustrating operation of a suction pipe.

Subsequently, a role of the projected piece 130 described hereinabove will be described with reference to FIGS. 8 to 10. FIG. 8 is a front elevational view of an entire spinning equipment, and FIG. 9 is a sectional view of the spinning equipment. Referring to FIG. 8, a large number of spinning units $U_1$, $U_2$, ... are disposed in a horizontal direction and generally constitute the spinning equipment. If a slub (thick yarn portion) is produced and the yarn is broken at one of the spinning units of the spinning equipment, then it is necessary to splice the yarn and render the spinning unit operative again. Such yarn splicing device is not provided for each spinning unit, but a yarn splicing bogie 133 common to the spinning equipment is disposed for traveling movement. In particular, the yarn splicing bogie 133 is disposed in a channel-shaped spacing 134 of the spinning equipment shown in FIG. 9 such that it may travel under the guidance of a pair of rails 135 and 136 to a position in front of a spinning unit for which yarn splicing is required in order to carry out yarn splicing. The yarn splicing bogie 133 has a yarn splicing device called knotter 137 and is constituted such that upper yarns (twisted yarns $Y_1$ and $Y_2$) at exits of the air nozzles 107 and 108 are carried to the knotter 137 by means of a suction pipe 138 (the position shown in FIG. 9 indicates an operative position) having a pair of suction holes at an end thereof while a lower yarn (spun yarn Y) of a yarn supply package P is carried to the knotter 137 by means of a suction mouth 139 (the position shown in FIG. 9 indicates a stand-by position) having a single suction hole at an end thereof. Particularly, with regard to the upper yarns, it is necessary for the suction pipe 138 to operate such that they may be positioned within the recess 121 of the yarn doubling guide 120 on the opposite sides of the separating bar shown in FIG. 7. While the suction pipe 138 is turned in the counterclockwise direction around the center provided by a fulcrum 140 to carry the upper yarns to the knotter 137 as shown in FIG. 10, thereupon the locus of the end of the suction pipe 138 substantially makes an arc. Accordingly, the upper yarns $Y_1$ and $Y_2$ will follow the loci of (1) → (2) → (3). At such a position spaced far from the end of the suction pipe 138 as the locus of (3), there is no guarantee that the upper yarns $Y_1$ and $Y_2$ are guided such that they may hold the separating bar 126 therebetween. However, if the upper yarns $Y_1$ and $Y_2$ are separated to the left and right by the projected piece 130 at such a position wherein the end of the suction pipe 138 is positioned near the air nozzles 107 and 108 as the locus of (1), then the upper yarns $Y_1$ and $Y_2$ will be guided such that they may hold the separating bar 126 with certainty therebetween.

Subsequently, operation of the spinning equipment having such a construction as described above will be described with reference to FIG. 7.

Referring to FIG. 7, the twisted yarns $Y_1$ and $Y_2$ which have been twisted by the air nozzles 107 and 108 pass the separating bar 126 and are doubled within the distance of the width "L" defined in accordance with the yarn thicknesses by the yarn defining plates 122 and 123 of the yarn doubling guide 120 so that they are entwined with each other to substantially make a single spun yarn Y. In this instance, the yarns $Y_1$ and $Y_2$ are moved to the higher tension side within the distance "L", and if, for example, the yarn $Y_2$ is higher in spinning out tension, then the yarns $Y_1$and $Y_2$ are both contacted with and guided by the right side width defining plate 122. Then, the separating bar 126 prevents the doubling point of the twisted yarns $Y_1$ and $Y_2$ from propagating to the upstream and keeps the doubling point at a fixed position. Further, due to the provision of the separating bar 126, coping with a demand that the twisted yarns $Y_1$ and $Y_2$ must be guided, upon yarn splicing, with certainty to the separating position of the separating bar 126, the projected piece 130 of the yarn guide 127 acts to keep the distance "W" when the twisted yarns $Y_1$ and $Y_2$ are guided from the air nozzles 107 and 108. Then, when the twisted yarns $Y_1$ and $Y_2$ are positioned in the recesses 128 and 129, the twisted yarns $Y_1$ and $Y_2$ just cross the separating bar 126 and enter the recess 121. It is to be noted that, if upper corners of the recess 121 and the width defining plates 122 and 123 are cut obliquely, then the twisted yarns $Y_1$ and $Y_2$ will be guided more cetainly. Further, the height "H" of the projected piece 120 is such a height that it separates the twisted yarns $Y_1$ and $Y_2$ immediately after the end of the suction pipe 138 has begun to guide the yarns (when the locus of (1) is taken) as shown in FIG. 10.

Since this embodiment has such a construction as described above, it exhibits the following effects.

Since the separating member for the twisted yarns are provided forwardly of the yarn doubling guide so that propagation of the doubling point of the two twisted yarns $Y_1$ and $Y_2$ to the upstream may be prevent to keep the doubling point forwardly of the yarn doubling guide, a stabilized spun yarn can be obtained without having a random influence on twists by the air nozzles 107 and 108.

Then, since the yarn guide for guiding the two twisted yarns in a separated relationship is provided between the air nozzles and the separating member and has the projected portion extending upwardly between the guide spacings for the two twisted yarns and having the narrow upper end and the lower portion which is greater in width than the separating member so that, when the two twisted yarns $Y_1$ and $Y_2$ are to be introduced, upon yarn break, to the knotter (yarn splicing device) by the suction pipe, the two twisted yarns $Y_1$ and $Y_2$ may be expanded and the distance between them may be maintained so that the twisted yarns may be positioned with certainty on the opposite sides of the separating member forwardly of the yarn doubling guide, incomplete guidance upon yarn splicing can be prevented.

What is claimed is:

1. Apparatus for producing spun yarn from a first sliver arranged in a first yarn path and a second sliver arranged in a second yarn path, the apparatus comprising:

first and second twisting means for twisting the first and second slivers in the first and second sliver paths, respectively;

a separating guide between the first and second sliver paths for maintaining the first twisted sliver separated from the second twisted sliver;

a passive guide member, arranged adjacent the separating guide, for guiding the first and second twisted slivers together at a location adjacent the separating guide, the passive guide member including:

a first member;

a second member spaced from the first member and defining a yarn passage gap in the space between the first and second members;

adjustment means for adjusting the width of the space between the first and second members to thereby adjust the width of the yarn passage gap;

a first plate having a U-shaped gap; and the first member comprises a second plate supported adjacent one side of the U-shaped gap and the second member comprises a third plate supported adjacent the opposite side of the U-shaped gap.

2. Apparatus as claimed in claim 1, wherein the adjustment means comprises:

support means for moveable supporting the third plate for movement toward and away from the second plate; and movement resisting means for selectively resisting movement of the third plate toward and away from the second plate.

3. Apparatus for producing spun yarn from a first sliver arranged in a first yarn path and a second sliver arranged in a second yarn path, the apparatus comprising:

first and second twisting means for twisting the first and second slivers in the first and second sliver paths, respectively;

a separating guide between the first and second sliver paths for maintaining the first twisted sliver separated from the second twisted sliver;

a passive guide member, arranged adjacent the separating guide, for guiding the first and second twisted slivers together at a location adjacent the separating guide, the passive guide member including:

a first member having a gap of width W; and a second member arranged adjacent the gap and selectively moveable with respect to the first member to selectively traverse a portion of the width W of the gap and to provide a yarn passage having a width defined by the portion of the width W which is not traversed by the second member.

4. Apparatus for producing spun yarn from a first sliver arranged in a first yarn path and a second sliver arranged in a second yarn path, the apparatus comprising:

first and second twisting means for twisting the first and second slivers in the first and second sliver paths, respectively;

a separating guide between the first and second paths for maintaining the first twisted sliver separated from the second twisted sliver;

a passive guide member, arranged adjacent the separating guide, for guiding the first and second twisted slivers together at a location adjacent the separating guide, the passive guide member including:

a first member;

a second member spaced from the first member and defining a yarn passage gap in the space between the first and second members, the yarn passage gap having a width W;

adjustment means for adjusting the width of the space between the first and second members to thereby adjust the width of the yarn passage gap, the separating guide being disposed between the passage guide member and the twisting means, and between the first and second members of the passive guide member, wherein the width W comprises a first width W1 between the first member and the separating guide, as viewed through the yarn passage gap toward the twisting means and a second width W2 between the second member and the separating guide member, as viewed through the yarn passage gap towards the twisting means; and the adjustment means comprises means for adjusting the width W1 independent of width W2.

5. Apparatus as claimed in claim 4, wherein the adjustment means further comprises means for adjusting the width W2 independent of the width W1.

6. Apparatus for producing spun yarn from a first sliver arranged in a first yarn path and a second sliver arranged in a second yarn path, the apparatus comprising:

first and second twisting means for twisting the first and second slivers in the first and second sliver paths, respectively;

a separating guide between the first and second sliver paths for maintaining the first twisted sliver separated from the second twisted sliver;

a passive guide member, arranged adjacent the separating guide, for guiding the first and second twisted slivers together at a location adjacent the separating guide, wherein the separating guide comprises an L-shaped member having a first leg extending between the first and the second yarn paths and between the passive guide member and the twisting means; and a second leg extending from the first leg and connected with the passive guide member.

7. Apparatus for producing spun yarn from a first sliver arranged in a first yarn path and a second sliver arranged in a second yarn path, the apparatus comprising:

first and second twisting means for twisting the first and second slivers in the first and second sliver paths, respectively;

a separating guide between the first and second sliver paths for maintaining the first twisted sliver separated from the second twisted sliver;

a passive guide member, arranged adjacent the separating guide, for guiding the first and second twisted slivers together at a location adjacent the separating guide, wherein the separating guide comprises a first separating member arranged adjacent the passive guide member and a second separating member arranged between the first separating member and the twisting means, the second separating member having a projected portion extending substantially perpendicular with the first and second yarn paths and between the first and second yarn paths, the projected portion having a free end having a converging width.

8. Apparatus as claimed in claim 7, wherein the second separating member has first and second recesses for receiving the first and second twisted slivers, respectively, the first and second recesses being arranged on opposite respective sides of the projected portion.

* * * * *